US005159798A

United States Patent [19]

Hannon

[11] Patent Number: 5,159,798

[45] Date of Patent: Nov. 3, 1992

[54] METHOD AND APPARATUS FOR TAPING CLOSED THE OPEN EDGE OF AN ASSEMBLED NEWSPAPER HAVING LOOSE CONTENTS

[75] Inventor: Charles N. Hannon, Olathe, Kans.

[73] Assignee: Stepper, Inc., Olathe, Kans.

[21] Appl. No.: 751,723

[22] Filed: Aug. 29, 1991

[51] Int. Cl.[5] ..... B65B 51/06

[52] U.S. Cl. ..... 53/415; 53/416; 53/135.1; 53/136.3; 156/216; 156/479

[58] Field of Search ..... 156/212, 216, 475, 477.1, 156/479, 486, 566; 53/128.1, 135.1, 136.1, 136.3, 397, 415, 416, 547

[56] References Cited

U.S. PATENT DOCUMENTS

| | | | |
|---|---|---|---|
| 2,926,907 | 3/1960 | Bromberg | 156/216 X |
| 3,002,324 | 10/1961 | Deaconson et al. | 53/397 |
| 3,145,516 | 8/1964 | Hannon et al. | 53/136.3 X |
| 4,004,962 | 1/1977 | Kleid | 156/475 |
| 4,160,687 | 7/1979 | Spear | 156/479 X |
| 5,009,055 | 4/1991 | Simmons | 53/397 |

*Primary Examiner*—John Sipos
*Assistant Examiner*—Daniel B. Moon
*Attorney, Agent, or Firm*—Hovey, Williams, Timmons & Collins

[57] ABSTRACT

An apparatus and method for taping closed the open edge of a composite newspaper is provided which includes a tape applicator for applying a portion of tape to one side of a newspaper, and a moving member presenting a surface moving downstream with the newspaper but at a greater speed relative thereto, whereby a remainder portion of the tape not adhered to the one side may be wrapped around the open end by temporarily adhering a portion of the remainder of the tape to the moving surface and transferring the tape thus temporarily adhered from the moving surface to the other side of the newspaper as the moving surface passes thereby in close adjacency. The apparatus includes a tape head group including parallel tape arm assemblies for applying tape to the newspaper, a carrier group including lower carrier belts and upper driven belts for carrying the newspaper therebetween in a downstream direction, and a moving belt presenting an adhesion resistant moving surface thereon for receiving a trailing remainder portion of the several tape in temporary adherence thereto prior to transfer of the remainder of the tape to the newspaper.

30 Claims, 8 Drawing Sheets

FIG. 9.
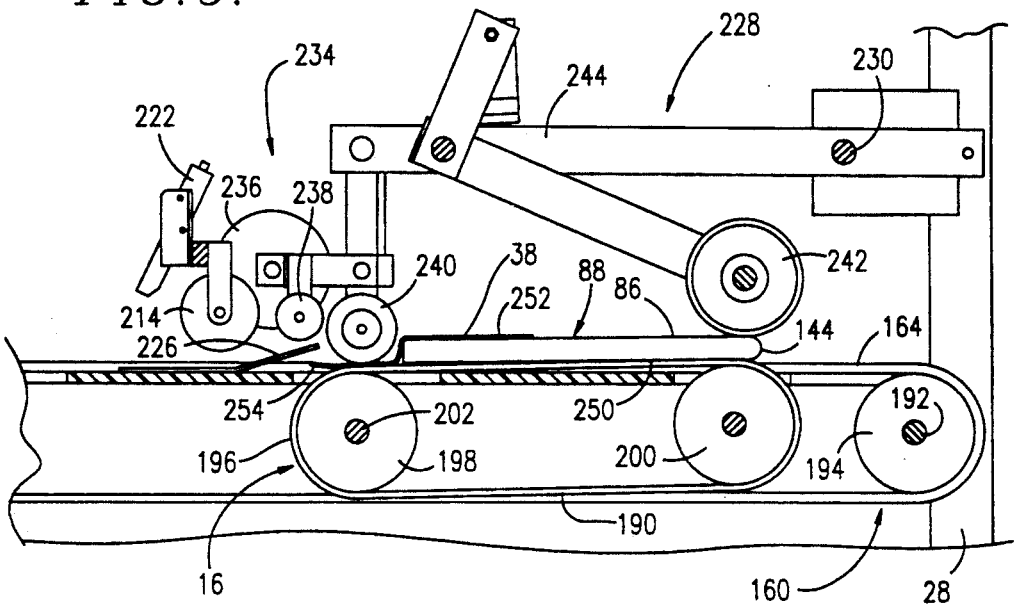
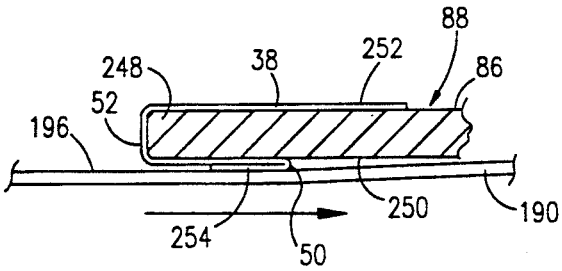
FIG. 11.
FIG. 10.
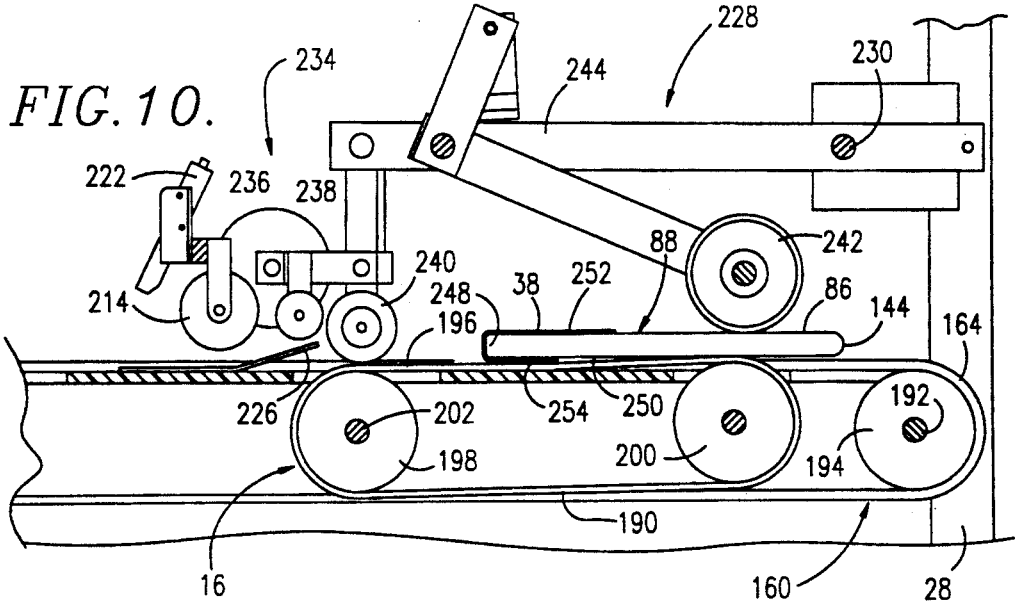

METHOD AND APPARATUS FOR TAPING CLOSED THE OPEN EDGE OF AN ASSEMBLED NEWSPAPER HAVING LOOSE CONTENTS

BACKGROUND OF THE INVENTION

1. Field of the Invention

This invention concerns a method and apparatus for applying tape to the open, trailing edge of a moving newspaper to prevent the contents thereof from escaping during handling and distribution. The apparatus and method are more particularly drawn to applying a tape having minimal adhesion so as to avoid damage to the newspaper during its removal, but nonetheless ensuring that the tape prevents the newspaper from prematurely opening.

2. Description of the Prior Art

The popularity of inserting preprinted, multicolored, advertising supplements is now well-recognized throughout the newspaper industry as well as by consumers. Preprinted advertising supplements often come in a multiplicity of sizes and thicknesses, and their finish may be dull or glossy and slick. In addition, many weekday and Sunday editions include several preprinted feature sections which dramatically increase the thickness of the final, composite newspaper.

Devices have heretofore been developed to handle and fold the multiple insert preprinted sections to make up the composite newspaper, such as those shown in, e.g., U.S. Pat. Nos. 3,595,560; 3,691,721; 3,698,704; 3,734,488; 3,762,701; 3,777,907; 4,557,472; 4,702,467; 4,805,381; 4,911,421; 4,919,413; 4,923,064; and 4,955,594. There has developed a real need for an economical means of preventing the preprinted sections of an assembled composite newspaper from being dislodged and separated either during handling at the publishers, distribution, or at the point of sale. In this regard, it is believed that the application of tape to the open edge of the newspaper opposite the fold represents the most efficient and effective way to retain the contents inside the fold.

However, the application of tape to the newspaper presents a number of significant problems. First, the newspaper, while being assembled, is received with the folded edge forward, or in the downstream direction. Thus, the tape must be applied to the trailing edge as the paper is moving. Second, newspapers are produced in considerable volume and in order to have the latest news printed in the newspaper, the deadline should be as late as possible. Thus, a high rate of production is essential to generate a quality product in sufficient quantities to meet demand. Third, newsprint paper is very prone to tearing, and in order for taping to be commercially acceptable, the tape must be able to adhere to the newsprint but be removable without tearing the pages to which it is applied. Fourth, the thickness of the newspaper to be taped will vary from day to day, and especially between weekday editions and the Sunday edition which traditionally contains numerous preprinted inserts. Because of this varying thickness, the placement and length of the tape must be adjustable. Finally, the preprinted inserts may be of different sizes and some may have a glossy finish, making them especially prone to shifting or falling out of the newspaper if roughly handled.

For all of these reasons, applying tape to hold the open edge of a newspaper closed has presented significant problems. There is thus a real need for a machine and method for applying tape to a newspaper at a high volumetric rate which can be located in the production line between the assembler and the stacker.

SUMMARY OF THE INVENTION

These problems are largely solved by the method and apparatus provided herein. The taping apparatus and associated method permit the application of tape to each newspaper at the open, trailing edge thereof without damage to the newspaper. The apparatus and method enable a high rate of newspapers to be processed therethrough by a unique tape application scheme whereby the tape is applied to the top of the newspaper, cut to desired lengths, and wrapped around the trailing open edge by temporarily adhering the free end of the cut tape to a moving member which passes underneath the newspaper to secure the open edge.

In this regard, the present invention is able to utilize a low-adhesive tape but still provide the desired attachment thereof to the newspaper. This is especially important because the newspaper would be damaged if a tape with a strong adhesive was removed, carrying with it a portion of the newspaper to which it adhered. The apparatus and method hereof attaches a low-adhesion tape to the newspaper during movement of the latter through the apparatus so that the tape is securely attached thereto, and further ensures that the tape is firmly pressed onto the newspaper so that the tape will not jam or tear as it passes therethrough. Thus, as the apparatus hereof receives literally thousands of newspapers per hour, the tape is applied to the newspaper and pressed thereon, and then "wiped" around the trailing, open edge and onto the underside of the newspaper so that the light adhesive tape adheres to the newspaper but can be easily removed by the consumer. Importantly, in so doing the apparatus hereof conserves the amount of tape so employed so that the minimum amount of tape, which is an extra expense for the publisher, is applied to the newspaper.

The apparatus hereof broadly includes a moving carrier for the newspaper, a means for applying a quantity of tape to one side thereof adjacent its trailing open edge with a portion of the tape at least initially unadhered to the newspaper, and a moving member presenting a surface located adjacent the other side of the newspaper opposite the one initially receiving the tape, the surface moving in the direction of movement of the newspaper for adhesively receiving thereon the initially unadhered portion of the tape. As the surface overtakes the newspaper, the initially unadhered portion of the tape—which has now adhered to the surface—is wrapped around the trailing open edge of the newspaper and progressively peeled off the surface and applied to the opposite side of the newspaper. Preferably, the tape is positively attached to the surface on the moving member and suitable pressing means such as shoes or rolls are employed to ensure the tape is positively bonded to the newspaper.

In greater detail, a newspaper is fed into the apparatus and transported therethrough on a carrier, whereupon the tape is applied by a tape head group which is adjustable for different thicknesses of newspapers. The arm receives tape having a light adhesive applied on at least one side thereof from a storage roll. An electric eye senses the movement of a newspaper on the carrier, which preferably includes a pair of transversely spaced belts for conveying the newspaper through the machine. The tape passes over a roller and is applied to the top surface of the newspaper as it passes therebeneath, and when a desired amount of tape has been fed through the tape head group, a knife is actuated to cut the tape at the desired length.

As the newspaper moves downstream on the carrier, the remainder of the tape is free and unadhered to the newspaper, and thus is oriented in trailing relationship to the direction of movement of the newspaper. At least a portion of the remainder of the tape is then applied to a surface on a moving member, such as, e.g., a belt. The surface to which the tape is applied is preferably smooth and resists adhesion to the tape, so that the tape is easily removed therefrom. For example, the surface may be of Teflon or other synthetic resin material which resists adhesion. The surface on the moving member is then advanced along underneath the newspaper so that the tape releases from the surface and is progressively applied to the newspaper. The carrier then carries the newspaper to a stacker or other machine with the trailing, open edge secured by the tape.

A number of sensors are employed with the apparatus hereof to prevent malfunctions during the taping process. As noted above, a sensor detects the passage of a newspaper into the machine for initiation of a taping sequence. Another sensor detects prolonged feeding of tape to avoid the circumstance where tape is fed continuously without cutting or when no tape is being fed. Another sensor detects low tape levels so that the apparatus automatically shifts tape rolls. Preferably, two tape head groups are provided so that the apparatus may be operated continuously, the second tape head group initiating operation when the supply of tape on the first tape head group is depleted. Another sensor detects the passage of the newspaper after the tape has been applied thereto to initiate a jet of air directed onto the leading portion of the tape, whereby the tape will be less likely to jam and peel back from the upperside of the newspaper when the tape is pressed thereto.

In addition, the operation of the apparatus is enhanced by a number of novel features concerning handling of the tape. For example, the tape head group includes a slack feeder or tape accelerator which initiates movement of the tape toward the tape head arm giving the tape roll forward inertia and providing some slack to avoid snapping the tape during high production rates. The tape head arm also includes a backlash preventer which prevents the residual tape, once severed from the portion applied to the newspaper, from snapping back out of taping position. Further, a slotted roller is located downstream of the tape head whereby air supplied by the air jet is not deflected but rather passes through the slots, thus urging the front edge of the tape applied to the top of the newspaper downward and thus making pressing of the tape easier.

Throughout the steps of the method hereof, the newspaper continues downstream substantially undisturbed by the taping process. That is to say, the composite newspaper retains its orientation and the tape is applied thereto without turning or substantial jostling thereof. In this way the newspaper retains its preprinted contents and once the taping operation is complete, the newspaper is oriented and ready for handling by conventional stacking machines just as if the taping process had not been performed, except that the newspaper is now much less likely to lose its contents during subsequent handling.

The method of the present invention broadly includes advancing a newspaper in a downstream direction with its open edge in trailing relationship, applying a portion of tape having one adhesive side to one side of the newspaper adjacent the open edge, adhering at least a portion of the remainder of the tape to a moving surface proximate the other side of the newspaper, and moving the surface in the direction of travel of the newspaper to overtake the latter and wrap the remainder of the tape around the open edge and adhere at least a portion of the remainder of the tape to the other side. Notably, the remainder presents a long "tail" trailing the newspaper. The long length of the remainder is necessary to wrap around a rough or irregular open edge and securely close the open end given the use of a light-duty adhesive. This "tail" is difficult to control. The taping is preferably accomplished without reorienting the newspaper, and the tape is preferably initially attached to the upper side of the newspaper, the remainder being subsequently transferred to the underside of the paper as it moves downstream.

BRIEF DESCRIPTION OF THE DRAWINGS

FIG. 9 is a fragmentary vertical cross-sectional view similar to FIG. 8 and showing the severed trailing portion of the tape adhering to a surface on the moving member;

FIG. 10 is a fragmentary vertical cross-sectional view similar to FIG. 9 showing the tape as it wraps around the open edge of the newspaper as the surface moves downstream;

FIG. 11 is a fragmentary vertical cross-sectional view similar to FIG. 10 showing the tape adhered to both the upper and lower sides of the newspaper adjacent the open edge.

DESCRIPTION OF THE PREFERRED EMBODIMENT

Figure 1:
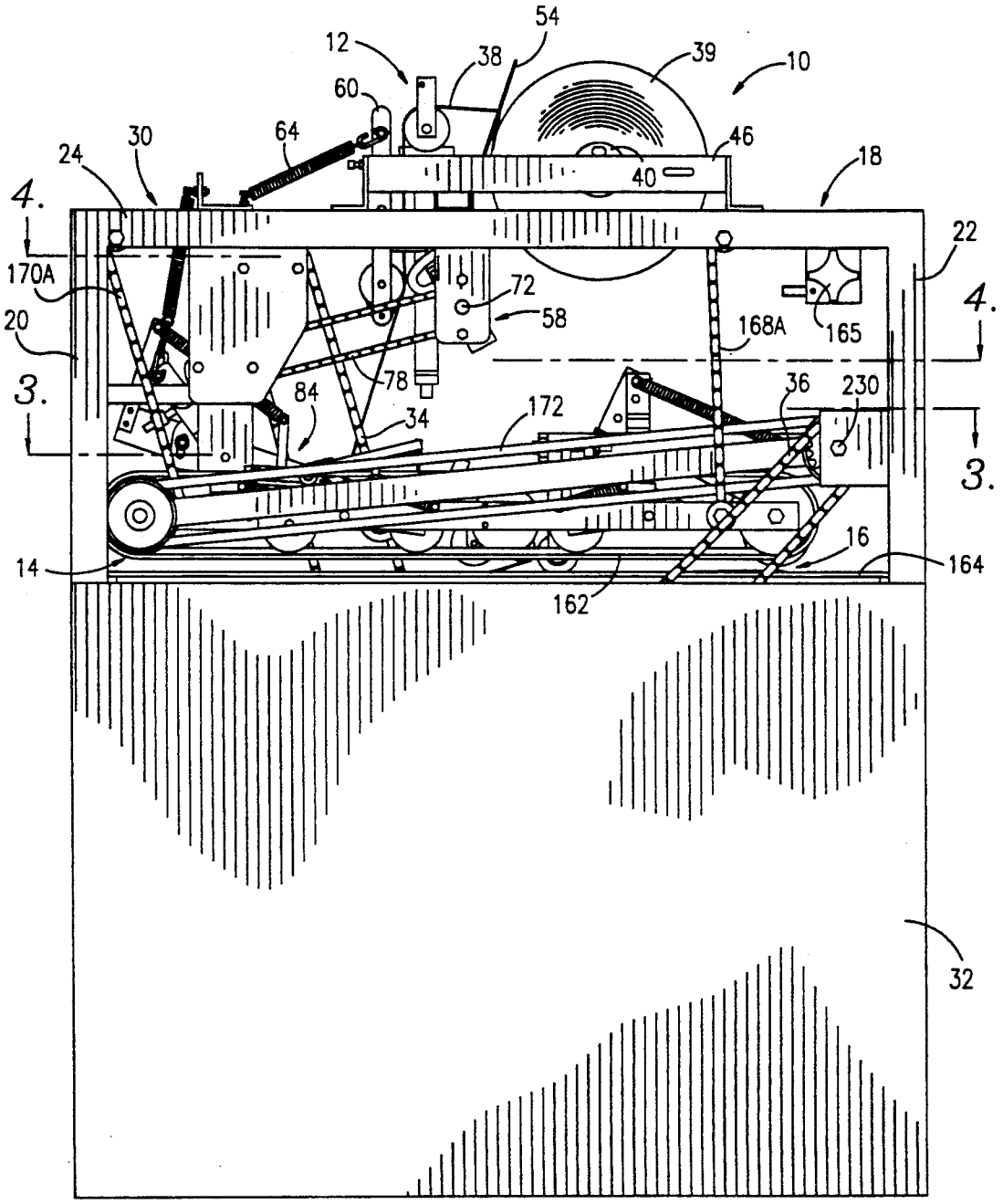
FIG. 1 is a right side elevational view of the apparatus for taping the open edge of a newspaper hereof, showing the frame, tape head group, and conveying belts for carrying the newspaper downstream.

Referring now to the drawing, an apparatus 10 for taping closed the trailing, open edge of a newspaper broadly includes tape head group 12, newspaper carrier group 14 and moving member 16 for receiving a remainder portion of tape on a surface thereon and then transferring that remainder portion into adhesive connection with the newspaper to enclose its open edge. A suitable frame 18 is provided for mounting the respective components at a suitable elevation and location and for housing the motor and various chain drives not immediately associated with the handling of a newspaper. The apparatus 10 hereof is configured to be located intermediate a solo inserter and a counter/stacker in the production line for the composite newspaper to be taped. While the apparatus 10 may be operated independently, it will be most efficiently employed where it is in position to receive a composite newspaper oriented with its folded, closed edge in a downstream direction (to the right as seen in FIG. 1) and then to deliver the newspaper to a counter/stacker in taped condition in the same orientation.

Figure 3:
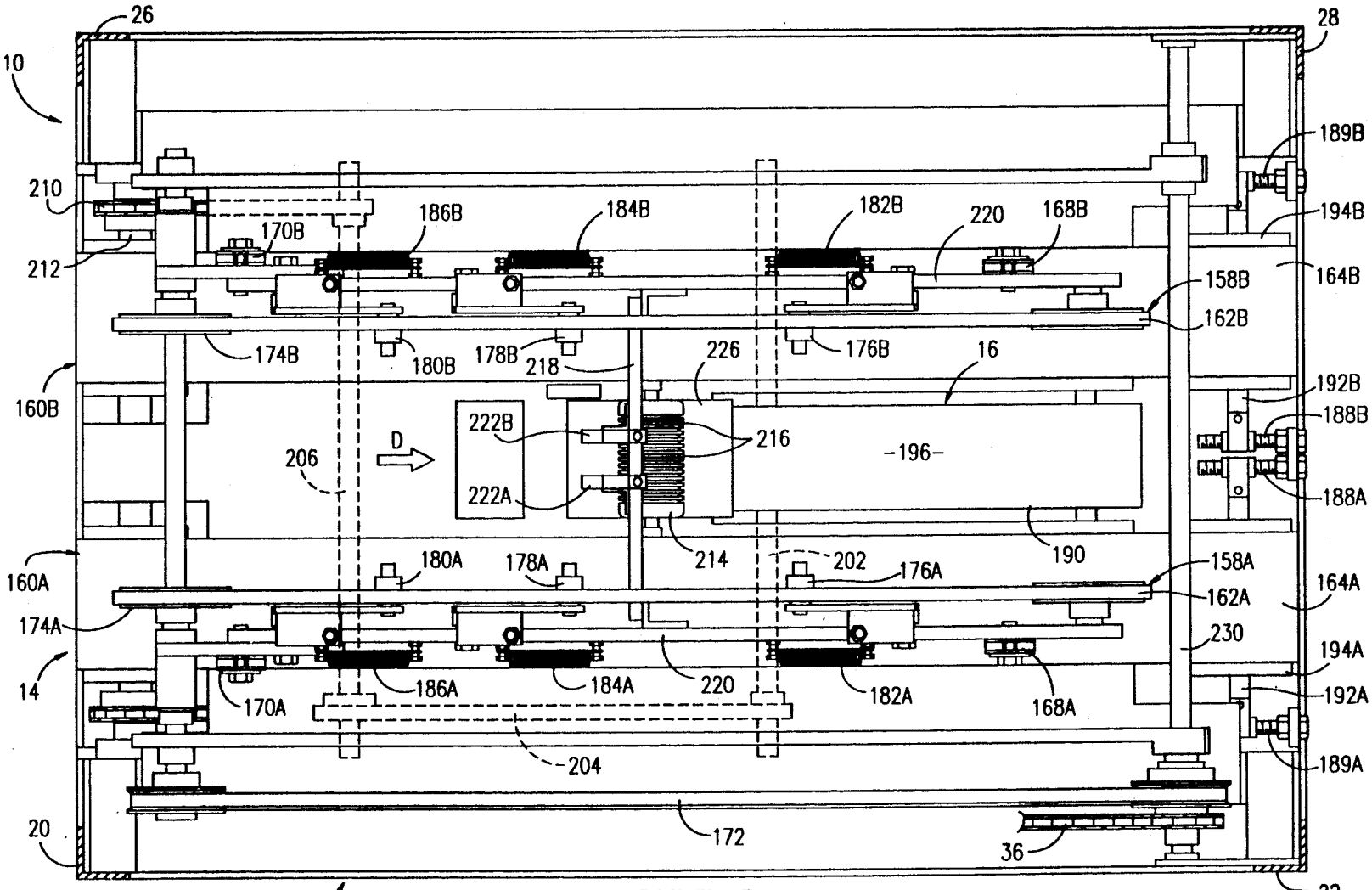
FIG. 3 is a horizontal cross-sectional view taken along line 3—3 of FIG. 1.

In greater detail, frame 18 presents a pair of spaced, upright supports 20 and 22 interconnected by a longitudinally extending beam 24. In viewing FIGS. 3 and 4, it may be appreciated that a second pair of upright supports 26 and 28 supporting a similar beam are transversely spaced relative to supports 22 and 24 to comprise an upper framework 30. Frame 18 also includes a lower cabinet 32 which includes a drive motor connected by sprockets and drive chains 34 and 36 for operating the newspaper carrier 14 and the tape head group 12 as well as moving member 16. Various intermediate shafts and gear reduction assemblies may be employed to provide the desired degree of gear reduction necessitated by the operating speed desired by the user, and it has further been found desirable to employ a jam-release clutch for connecting the drive motor to the chains 34 and 36, either directly or indirectly. One clutch useful in connection with this application is a jam-release clutch sold under the designation Morse Torque-guard Model TG-60 sold by the Morse Chain Company of Ithaca, N.Y. In addition, cabinet 32 includes connections for the various electrical components and connections to a source of external electrical power, as well as a connection to a source of compressed air and a conventional manifold for distributing the compressed air to the operating components. For safety reasons, an emergency shut-off switch (not shown) is provided to cut power to and thus stop operation of the apparatus 10.

Figure 2:
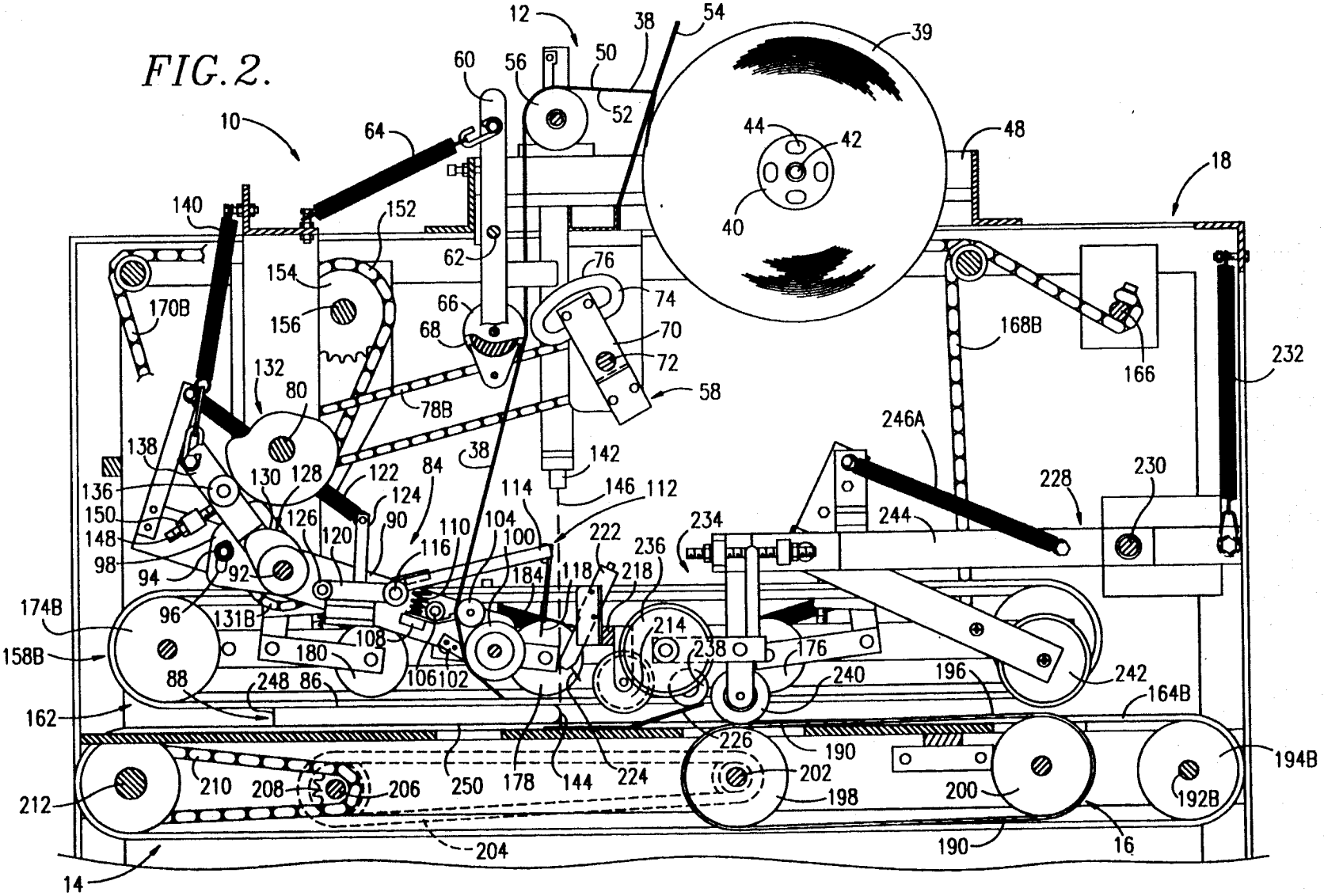
FIG. 2 is a fragmentary vertical cross-sectional view taken along the longitudinal centerline of the apparatus hereof, showing the tape head group and the moving member downstream thereof.

Tape head group 12 includes a roll 39 of tape 38 mounted on a hub 40 as shown more clearly in FIG. 2. Tape 38 may be of a variable diameter, but it has been found that a tape roll 39 of six inches to twelve inches in diameter is preferable, and normally an eight inch roll is satisfactory for most applications. One type of tape which has been found particularly useful in connection with this invention is a ¾ inch wide Post-It ® tape manufactured by 3-M of Minneapolis, Minn. The advantage of this type of tape is that it has a light-duty adhesive, thereby minimizing damage to the newspaper upon removal thereof. Hub 40 is preferably an anti-reverse bearing provided with an internal bearing clutch, such as a Torrington clutch bearing available from Industrial Bearing and Transmission of Kansas City, Mo.

It is to be understood that the tape head group provides parallel assemblies each provided with a roll of tape 39. Thus, when one of the two, side-by-side rolls of tape is depleted, the apparatus 10 hereof automatically switches so that the second roll 39B adjacent to the first roll 39 begins supplying tape to its respective tape arm assembly for application to the newspapers passing through the apparatus.

Hub 40 is located on a spindle 42 and is able to roll only in one direction, this being clockwise as shown in FIGS. 1 and 2. Hub 40 is preferably about three inches in diameter which conveniently accommodates an appropriate roll 39 of tape 38. Hub 40 is provided with a plurality of reflectors 44 each preferably of reflective tape. Hub 40 is mounted opposite strut 46 which mounts a pair of adjustably mounted electric eyes thereon. One eye is located opposite the circular path of reflectors 44 while another electric eye is located opposite and radially just outside the outer margin of hub 40. A stationary reflector is positioned on strut 48 opposite the other electric eye, whereby depletion of the roll of tape 38 will result in a return reflection of the beam of light generated by the other electric eye. An electric eye found useful in this application is a model SE 612 LVNC from Banner Engineering of Minneapolis, Minn. A total of five such electric eyes are used in this apparatus 10.

Tape 38 is provided with an adhesive side 50 and a non-adhesive side 52. As the tape 38 unwinds from the roll 39, it passes through a slot in a tape roll brake 54 and over roller 56 with the adhesive side oriented away from the roller 56. Tape 38 then passes to a tape accelerator 58 for providing slack during initial application of the tape to a newspaper. Tape accelerator includes tensioner arm 60 pivotally mounted on pin 62 and biased in a counter-clockwise direction as viewed in FIG. 2 by spring 64. At the end of tensioner arm 60 distal to spring 64, a tensioner roller 66 is provided which includes a pulley 68 presenting a plurality of circumferentially extending slots and over which the adhesive side 50 of tape 38 passes. An advance arm 70 is pivotally mounted on driven shaft 72 in a counter-clockwise direction as shown in FIG. 2 and is provided with pad 74 presenting an arcuate distal rim 76 thereon. The pad 74 is positioned whereby the rim 76 rotates into engagement with tensioner roller 66 during a portion of its rotation on shaft 72. Each chain drive 78A and 78B (corresponding to each of the parallel taping assemblies) serves to rotate shaft 72 and thus advance arm 70 responsive to rotation of the corresponding main shaft 80A or 80B when engaged by respective single-wrap clutch 82A or 82B. As used herein, the suffix "A" and "B" denominate the same components positioned on respective sides of the apparatus 10.

Tape head group 12 also includes a taping arm assembly 84, with corresponding taping arm assemblies 84A and 84B provided for parallel operation as described hereinabove. Taping arm assemblies 84 are adapted to receive the tape 38 from the tape accelerator 58 and apply the tape 38 to the normally uppermost side 86 of a newspaper 88. Each taping arm assembly includes an elongated tape arm 90 which is mounted for free pivotal movement on tape arm shaft 92. Tape arm 90 is adjustable to vary the height of the distal end thereof by a nut and bolt connection 94 in slot 96 interconnecting tape arm 90 with strut 138 mounting plate 98.

Figure 4:
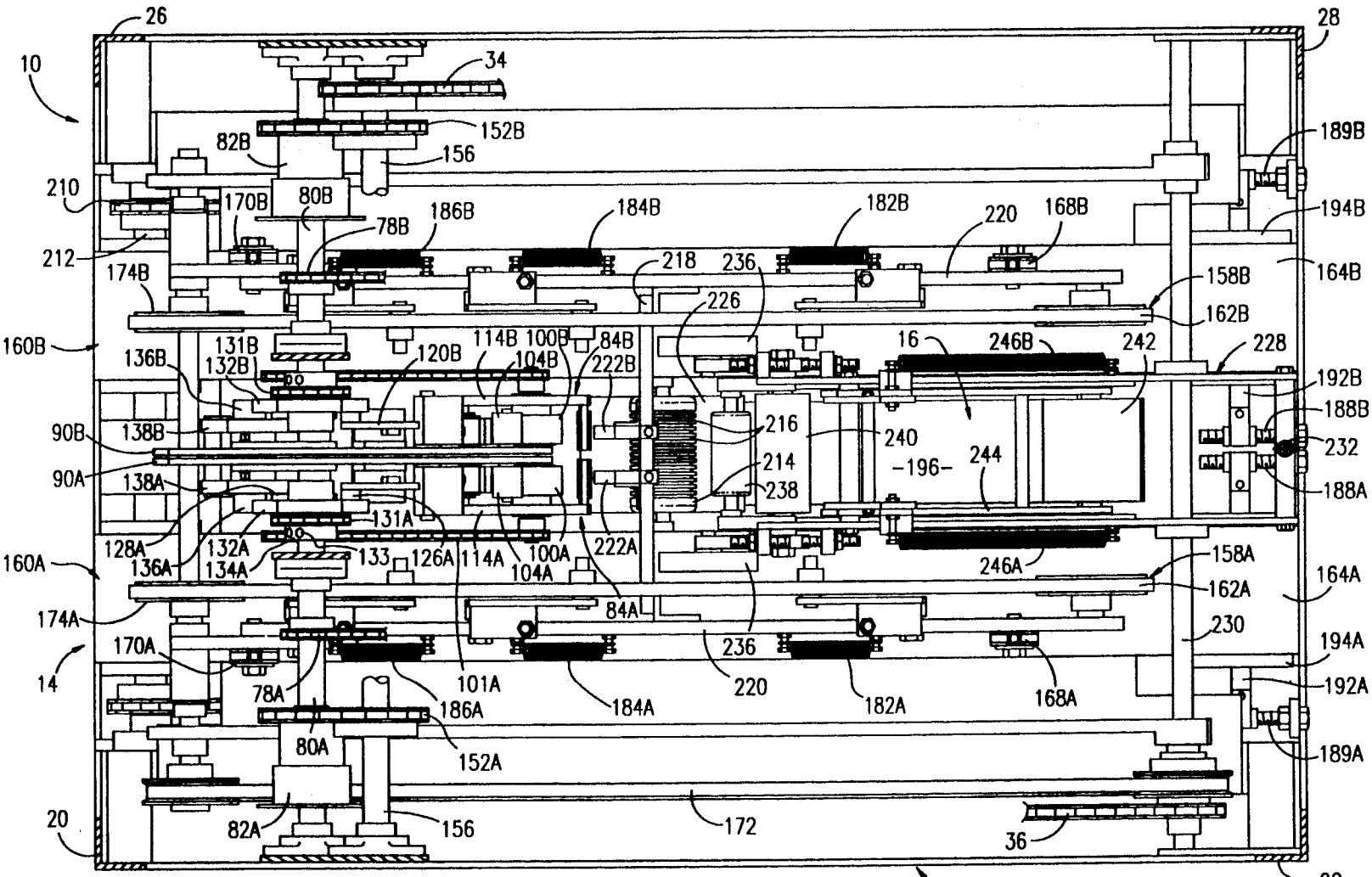
FIG. 4 is a horizontal cross-sectional view taken along line 4—4 of FIG. 1.

At the end of tape arm 90 remote from mounting plate 98, an application roller 100 is rotatably mounted on tape arm 90 and driven by chain 101 best seen in FIG. 4. Application roller 100 is mounted opposite tape guide 102 which is preferably of nylon to resist adhesion to the adhesive side 50 of tape 38 as the tape is advanced by the rotation of application roller 100. By driving application roller 100 rather than merely permitting it to rotate freely, the tape 38 may be applied more uniformly and the application roller 100 will compensate for different degrees of "stickiness" of the tape. Before reaching guide 102, tape 38 first passes between anti-backup roller 104 and butterfly rocker 106 which is biased toward anti-backup roller 104 by weight 108 and spring 110. Thus, tape 38 is free to advance between anti-backup roller 104 and butterfly rocker 106 toward guide 102, but is prevented from snapping back because of the camming action of butterfly rocker 106 toward anti-backup roller 104 when the tape 38 moves in reverse toward tape accelerator 58. Butterfly rocker 106 also aids in resisting forward movement of the tape 38 during cutting thereof.

Tape arm 90 additionally mounts tape cutter assembly 112. Tape cutter assembly 112 includes tape cutter arm 114 pivotally mounted on pin 116 and mounting cutter knife 118 presenting an angled edge thereon, the knife 118 being at the remote end of cutter arm 114. Cutter arm 114 is fixed relative to cutter follower arm 120 and biased to an upward position by the action of spring 122 on finger 124 rigidly connected to cutter follower arm 120. Cutter follower arm 120 mounts cutter follower 126 which is located proximate shaft 92 for engagement with cutter cam 128 during a portion of its rotational cycle. Cutter cam 128 is freely rotatable about shaft 92 and includes a radical drop surface 130 whereby cutter knife 118 will quickly move to sever the trailing portion of tape 38 applied to a newspaper 88 from the remainder of the tape connected to the roll 39. Cutter cam 128 is fixed relative to a sprocket (not shown) driven by a chain 131 driven off drive shaft 80. Sprocket 134 is fixed on drive shaft 80 by an allen screw extending through one of a plurality of circumferentially spaced holes 133 in the sprocket and a recess in the drive shaft 80. The amount of tape to be applied to the newspaper may be adjusted by removing the allen screw and rotating the sprocket 134 on shaft 80 to place a new hole 133 in alignment with the recess on the shaft and rethreading the allen screw therein.

Tape arm 90 is actuated to place application roller into contact with newspaper 88 by tape head cam 132 fixedly mounted on drive shaft 80 for rotation therewith. Tape arm follower 136 is rotatably mounted on strut 138 extending from and fixed relative to tape arm 90. Strut 138 is biased upwardly (and thus the distal end of tape arm 90 carrying application roller 100 is biased downwardly) by spring 140 and further urged upwardly by the weight of the arm 90 and its constituent members mounted thereon. The total force applied by the spring and the weight of the arm at the application roller is about 18 pounds in the preferred embodiment.

Relative upward and downward movement of the tape arm 90 about shaft 92 is caused by the rotation of tape head cam 132 acting on tape arm follower 136. As noted above, shaft 80 rotates when single-wrap clutch 82 is engaged. Single-wrap clutch 82 is preferably a Warner WRAP-SPRING clutch manufactured by the PSI Division of Warner Electric Company of Pitman, N.J., the preferred model number is CB6. The single-wrap clutch 82 is electronically connected to an electric eye 142 which is directed downwardly toward a strip of reflective tape for detecting the folded, leading edge 144 of a newspaper 88 as it passes therebeneath. When the light beam 146 generated by electric eye 142 is broken, clutch 82 engages shaft 80 to initiate rotation of the tape head cam 132. Stud 148 provided with locknut 150 serves as a backup to nut and bolt connection 94 for properly positioning tape head arm 90 relative to tape head arm follower 136 and strut 138. Stud 148 is threadably secured to tape arm 90 and bears against the edge of strut 138. Drive shaft 80 is in turn driven by drive chain 152 rotated by sprocket 154 fixed on shaft 156, shaft 156 in turn being driven by chain 34.

Newspaper carrier group 14 broadly includes an upper belt assembly 158 and a lower belt assembly 160. The upper belt assembly 158 preferably includes a pair of spaced-apart driven belts 162 spaced about one inch above a pair of carrying belts 164 of lower belt assembly 160. Such an arrangement provides satisfactory pressure in most applications to ensure a newspaper 88 is firmly grasped therebetween and moved downstream without jamming, both driven belts 162A and 162B and both carrying belts 164A and 164B being made of a rubber or synthetic rubber material having a nubby exterior surface for holding a newspaper 88 therebetween. However, the height of the upper belt assembly 158 above and relative to lower belt assembly 160 may be adjusted by turning a knob 165 connected to spindle 166 whereby lifting chains 168 and 170 may serve to raise and lower the upper belt assembly 158. Upper belt assembly is driven by chain 36 which rotates drive belt 172 to rotate a pulley 174. In addition, idler pulleys 176, 178 and 180 serve to maintain tension in the driven belt 162 by the application of force exerted by corresponding springs 182, 184 and 186. The driven belt 162 remains in engagement with the newspaper 88 substantially the entire length of time wherein a quantity of tape 38 would be applied and wrapped around newspaper 88. Similarly, carrying belt 164 extends substantially the entire length of the apparatus 10 and suitable tension is maintained on each of the transversely spaced carrying belts 164A and 164B by tensioning bolts 188 and 189 acting on respective shafts 192 carrying drums 194 for each carrying belt 164. It is to be understood that the driven belts 162A and 162B, as well as the carrying belts 164A and 164B are transversely spaced a sufficient distance to receive moving belt 190 therebetween, but nevertheless to remain in engagement with the newspaper 88 moving through the apparatus 10.

Motive member 16 includes an endless moving belt 190 presenting an adhesive-resistant surface 196 thereon, the surface 196 being oriented to receive the adhesive side 50 of a portion of tape 38 thereon. The moving belt 190 is preferably a polyester belt with a Teflon surface 196 such as, for example, an A-13 or A-14 belt available from Industrial Bearing and Transmission of Kansas City, Mo. The moving belt 190 is preferably positioned substantially coplanar with or about ⅛ inch below carrying belts 160 and operates preferably at about four times the linear speed of the carrying belt 160. The length of the moving belt 190 can be varied according to the rate of production desired, but it has been found that a belt presenting an upward facing surface 196 and thus effective linear length between the centers of upstream drum 198 and downstream drum 200 over which the moving belt 190 is stretched in excess of about one foot is desirable, with production rates of 15,000 newspapers per hour being achieved with a belt having an effective linear length between the centers of upstream drum 198 and downstream drum 200 of about three feet. The moving belt 190 is secured to and rotatable with jackshaft 202. Jackshaft 202 is in turn rotated by transfer chain 204 mounted on a sprocket secured to transfer shaft 206. Transfer shaft 206 is rotated by a sprocket 208 fixed thereto and driven by chain 210 connected to leadshaft 212 powered by chain and sprockets (not shown) in lower cabinet 32. The belt assembly 160 is driven by pulleys on leadshaft 212.

Located just upstream of motive member 16 is a slotted roller 214 presenting a plurality of transversely spaced, circumferentially oriented slots 216. The slotted roller 214 is positioned just upstream of the motive member 16 for engagement with the side of the newspaper facing upwardly. Slotted roller 214 is located intermediate the carrying belts 162A and 162B and of sufficient width to pass over tape 38 applied to a newspaper 88 by either tape arm assembly 84A or 84B. Slotted roller 214 is mounted on a cross-beam 218 attached to the subframe 220 of the upper belt assembly 158, the subframe 220 being suspended at the selected height by adjusting lifting chains 168, 170. A pair of air jets 222A and 222B are located in side-to-side, parallel relationship on cross-beam 218 for directing a jet 224 of air in a generally down and downstream direction toward the bottommost portion of slotted roller 214 and any tape 38 attached to the upper side of a newspaper 88 passing therebeneath. A nylon plate 226 is angled in an upward and downstream direction. The plate serves to prevent the trailing portion of the cut tape from bunching up and adhering to itself prior to application of the remainder or trail of the tape to the surface 196.

A pressing group 228 is mounted to frame 18 for pivotal movement about pressing group shaft 230 and biased downwardly by press spring 232. Pressing group 228 includes progressive roller assembly 234, including first upstream roller 236 preferably presenting the greatest diameter, intermediate roller 238 and lowermost roller 240 for gradually riding up and over a newspaper 88 passing therebeneath. The progressive roller assembly 234 provides a gradual application of pressing force without a likelihood of jamming even a thick newspaper. Pressing group also includes final press cylinder 242 which is pivotally mounted relative to leg 244 and biased downwardly toward surface 196 by tension spring 246. In this regard, upstream drum 198 and downstream drum 200 act as anvils for roller 240 and cylinder 242. If additional rollers are desired between roller 240 and cylinder 242 for pressing the tape 38, then additional drums would preferably be located beneath moving belt 190 especially as the effective length of belt 190 increases.

As noted previously, newspapers are assembled with the open edge in trailing relationship, so that the folded edge is forward as the newspapers are delivered downstream to the counter-stacker. Thus, the newspaper 88 is fed into the taping apparatus 10 with its folded edge 144 in leading relationship and downstream relative to open edge 248. Each newspaper 88 also presents a first, normally uppermost side 86 and a second, normally lowermost side 250 as the newspaper 88 lays flat for passage through the taping apparatus 10.

In operation, the taping apparatus 10 receives the newspaper 88 and must continue to advance the newspaper downstream (the direction indicated by the arrow D in FIG. 3) at a rate at least equal to the feed rate of the assembler which is conventionally located upstream. Normally, the production rate of the apparatus can easily accommodate 7,000 newspapers per hour, but by lengthening the moving belt 190 to about three feet of effective length between drums 198 and 200 and increasing the speed of both the carrier group 14 and the moving belt 190, production may be increased to 15,000 newspapers per hour with the apparatus described herein.

As the newspaper 88 passes into the machine, the tape arm assembly 84 is in the raised position and located with the application roller 100 preferably about ¾" to 1 inch above the uppermost side 86. The tape arm may be adjusted vertically by loosening the nut and bolt connection 94 and backing off the adjustment stud 148 until the proper spacing has been acquired. It should also be noted that the thickness of the newspaper 88 may necessitate raising or lowering of the upper belt assembly which can be lifted or lowered by turning knob 165 to rotate spindle 166.

Beam 146 serves to detect the leading, folded edge 144 of the newspaper 88 as it passes therethrough. Upon sensing the newspaper 88, the electric eye 142 initiates a signal to the single-wrap clutch 82 to cause the shaft 80 to rotate. It is to be understood that only one clutch 82A or 82B would be actuated as only one tape arm assembly 84A or 84B would be in operation at any one time. As shaft 80 turns, cam 132 turns and follower 136 causes tape arm 90 to drop onto the newspaper 88. The amount of tape dispensed is adjusted by removing the allen screw inserted in a hole 133 in sprocket 134 and rotating the sprocket relative to the shaft 80, thus altering the timing of cutter cam 128 driving the cutter arm 114 and knife 118 downward, thereby altering the amount of tape applied to the newspaper. In the preferred embodiment, lengths of 6, 8, 10 and 12 inches may be dispensed by such an adjustment. Additionally, an electronic adjustment (not shown) for the timing of the clutch actuation is preferably provided, thereby adjusting the longitudinal location along the newspaper 88 where the tape 38 is initially placed. This is accomplished by a programmable controller with timers built in and operably connected to the clutch 82 and electric eye 142.

Tape 38 is supplied by tape roll 39. The electric eye opposite reflectors 44 monitors the number of reflections received from reflectors 44. If no reflections are recorded for a set period or set number of detections by electric eye 142, the tape is not feeding and the apparatus 10 shuts down. If the electric eye detects an excessive, e.g. 15, reflections for a single reflection from electric eye 142, then the tape 38 is not being cut and is running away. In the latter event, the apparatus 10 automatically shuts off. If the diameter of the roll 39 diminishes almost to hub 40, another electric eye detects a reflection from the now exposed reflecting tape opposite thereto, and tape arm assembly 84A stops and tape arm assembly 84B begins, with a parallel roll 39B now supplying tape.

As the tape arm 90 moves down whereby the application roller 100 moves into engagement with the uppermost side 86 of the newspaper 88, the pad 76 of the tape accelerator 58 serves to advance a portion of the tape 38 to provide slack before the tape 38 is stretched by attachment of a portion thereof to the uppermost side 86. The pad 76 engages the tape 38 and pushes a portion down toward the tape arm 84 as the chain 78 causes the shaft 72 to rotate. After this brief, initial engagement, the pad moves out of contact with the tape 38 until another newspaper passes beneath electric eye 142 and the process is repeated. Tape is also positively advanced onto the paper by application roller 100 which is rotated in a counter-clockwise direction, as viewed in FIG. 2, by chain 101, best seen in FIG. 4.

Chain 101 is rotated by shaft 92, which in turn is driven off chain 131. As shaft 80 rotates, cam 128 is rotated about shaft 92 for the purpose of cutting the tape applied to the newspaper 88 to the desired length. As cam 128 rotates into engagement with follower 126, cutter arm 114 drops downwardly so that knife 118 severs the tape 38 applied to the newspaper 88 from that portion still connected to the roll 39. Upon severing, the tape 38 remaining connected to the roll has a tendency to snap-back; anti-backup roller 104 and butterfly rocker 106 serve to prevent this occurrence.

FIGS. 5 through 12 illustrate diagrammatically the sequence of events wherein the tape 38 is applied to a newspaper 88 and wrapped around the trailing, open edge 248 thereof using the apparatus and in accordance with the method of the present invention.

Figure 5:
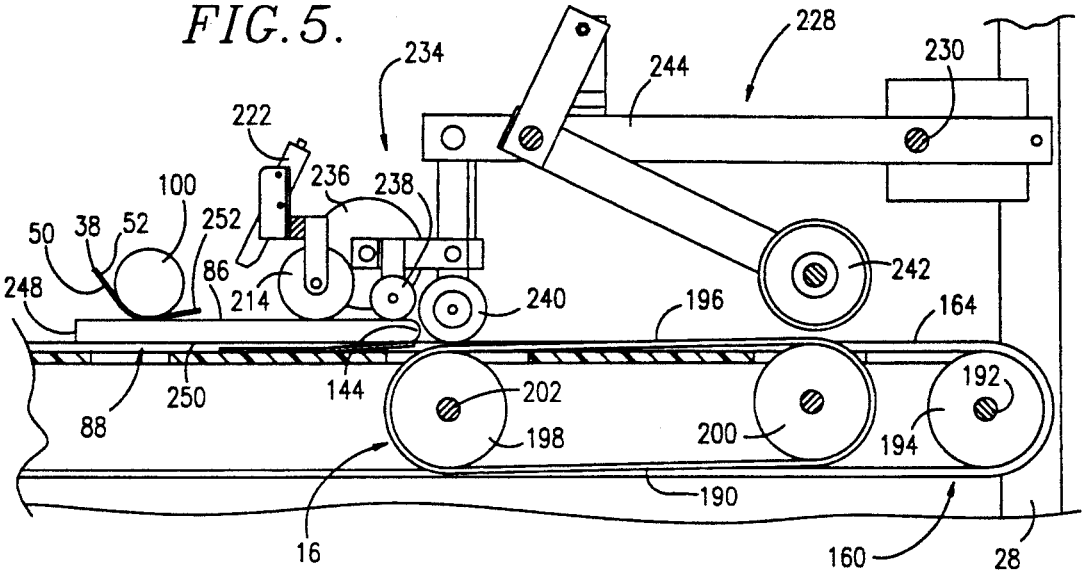
FIG. 5 is a fragmentary vertical cross-sectional view taken along the longitudinal axis of the apparatus hereof showing the application of tape to the upper surface of a moving newspaper.
Figure 6:
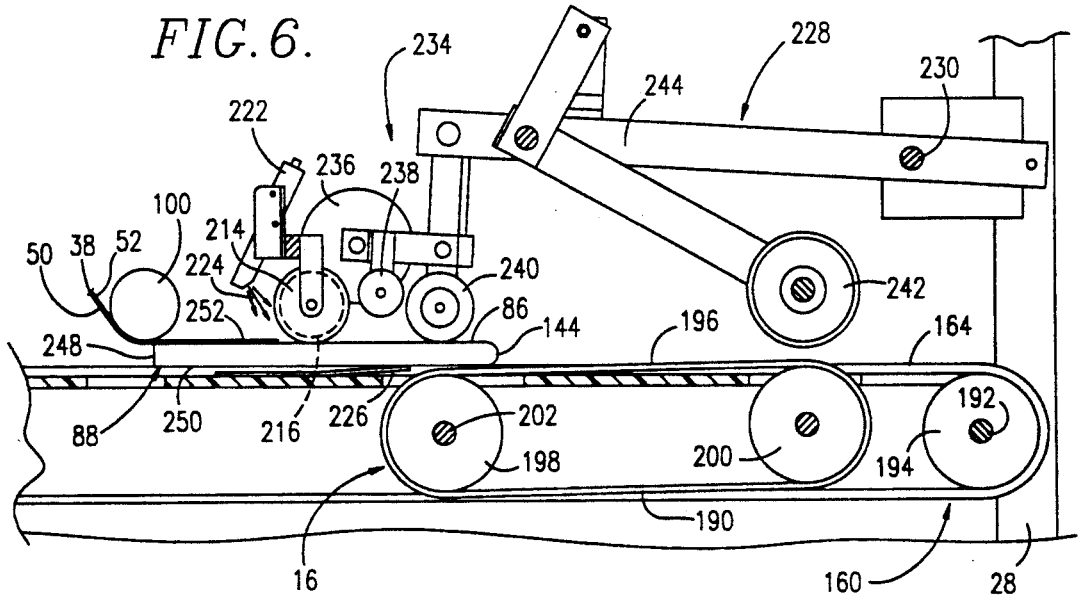
FIG. 6 is a fragmentary vertical cross-sectional view similar to FIG. 5 but with the newspaper advanced downstream, showing the application of air to the top surface of the paper and the leading edge of the tape.

FIG. 5 illustrates the downstream portion of the apparatus 10 including the moving member 16 and pressing group 228 as the newspaper 88 begins receiving tape 38 thereon. Application roller 100 serves to deposit tape 38 thereon adjacent the open edge 248. As the newspaper 88 moves downstream, closed end 144 moves beneath progressive roller assembly 234 and slotted roller 214. As shown in FIG. 5, the newspaper 88 begins receiving tape 38 thereon for the folded edge 144 passes over moving belt 190. As the tape 38 is applied, it is possible that a leading portion 252 may not adhere to the uppermost side 86.

As the newspaper 88 continues to move downstream, it engages lowermost roller 240 and leg 244 begins to lift slightly so that newspaper 88 may pass therebeneath. It may also be seen in FIGS. 5 and 6 that nylon plate 226 has been folded downwardly as the newspaper 88 passes thereover. In order to prevent the leading portion 252 of the tape 38 from peeling back as the tape 38 is pressed onto the newspaper 88 for good adhesion thereto, air jet 222 directs jet of air 224 downwardly and in a downstream direction to force the leading portion 252 down flat onto the uppermost surface 86 of the newspaper 88. Because the slotted roller 214 is provided with the plurality of slots 216 therein, the air is not blocked with resulting eddys which could force the leading edge up, but rather permitted to pass through the slots beneath slotted roller 214.

Figure 7:
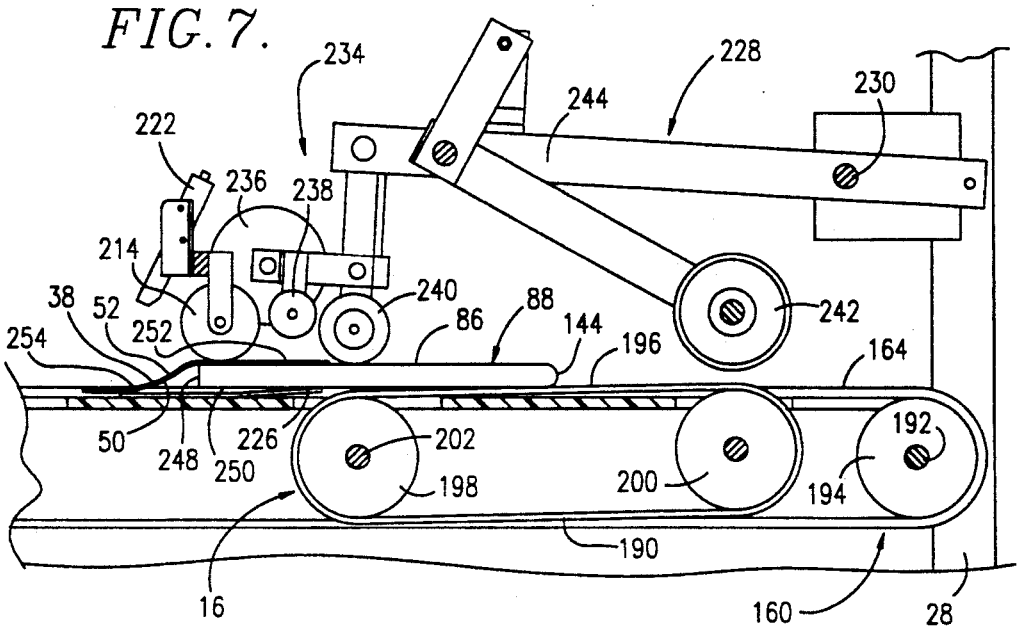
FIG. 7 is a fragmentary vertical cross-sectional view similar to FIG. 6 showing the severed trailing portion of the tape as the newspaper moves pass the anti-kickback flap.
Figure 8:
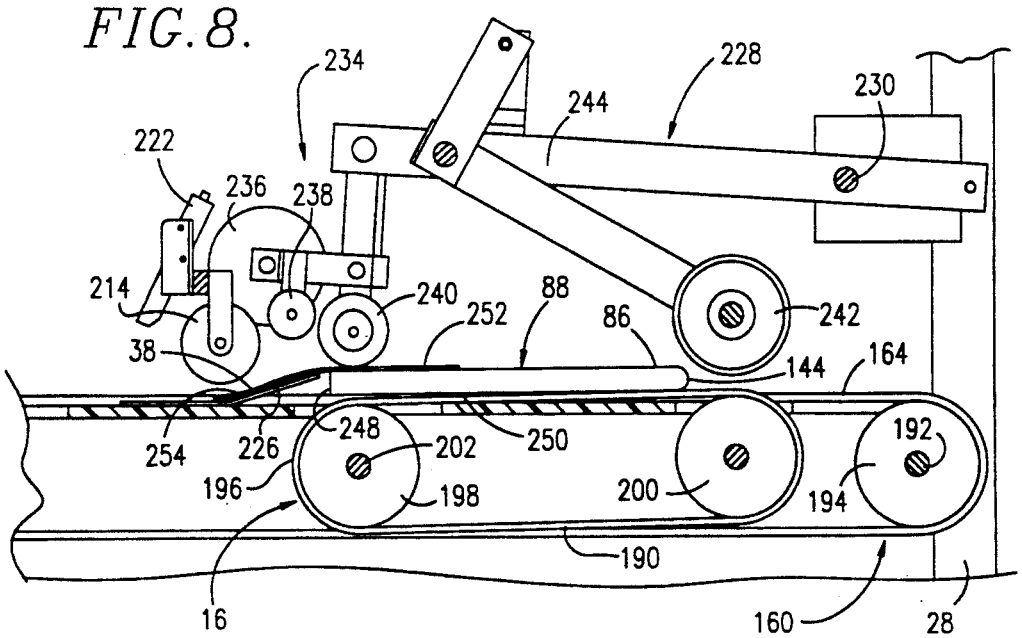
FIG. 8 is a fragmentary vertical cross-sectional view similar to FIG. 7 showing the newspaper as it moves over the moving member.

FIG. 7 illustrates the position of the newspaper 88 after the tape 38 has been severed by progressive cutting across the tape 38 by the angled knife, the leading portion 252 having passed beneath slotted roller 214. In FIG. 7, the leading portion 252 has been adhered to the uppermost surface 86 of the newspaper 88, leaving a remainder 254 which has not been adhered to the uppermost surface and trails behind. The slotted roller 214 passes over the leading portion 252 of the tape 38 to provide adhesion between the light-duty adhesive on the adhesive-coated side 50 of the tape 38 and the newspaper 88. In FIG. 8, newspaper 88 continues to move in a downstream direction. It should be noted during this phase that the newspaper itself is carried and held in position by upper belt assembly 158 and lower belt assembly 160, the engagement between the carrying belts 164 and the driven belts 162 securely holding the newspaper for movement downstream at a steady rate. Thus, although the Teflon, adhesive-resistant surface 196 of moving belt 190 may engage the lowermost side 250 of the newspaper, it will not serve to carry or propel the newspaper downstream. Preferably, belt 196 moves downstream at four times the speed of the driven belt 162 and the carrying belt 164. Nylon plate 226 serves to prevent the tape 38 from falling downwardly into engagement with surface 196 of belt 190 prematurely. If tape 38 were to contact and adhere to surface 196 too early, the tape would be driven into open edge 248 rather than wrapped around for engagement with lowermost side 250.

FIG. 9 illustrates the application and temporary adhesion of the adhesive-coated side 50 of the remainder 254 of tape 38 to the adhesive-resistant Teflon surface 196 of moving belt 190. Lowermost roller 240 serves to temporarily direct and hold the remainder portion 254 of tape 38 against the surface 196, and in this manner the tape may begin to wrap around the open edge 248 as shown in FIG. 9. Also, as may be seen in FIG. 9, final press cylinder 242 begins to roll over the uppermost side 86 of newspaper 88 whereby downward force is exerted on the cylinder 242 by tension spring 246.

In FIG. 10, the tape 38 has wrapped around the open edge 248 of the newspaper 88 because the moving belt 190 moves much faster than the carrying belt 164 and the driven belt 162. As the surface 196 to which the adhesive-coated side 50 of the remainder 254 moves forward relative to the newspaper 88, the tape 38 is progressively peeled off the adhesive resistant surface 196 and transferred onto the second, normally lowermost side 250 of the newspaper 88 as shown in detail in FIG. 11. Thus, as the surface 196 moves downstream, tape 38 is transferred therefrom to the lowermost side 250 of the newspaper 88.

Figure 12:
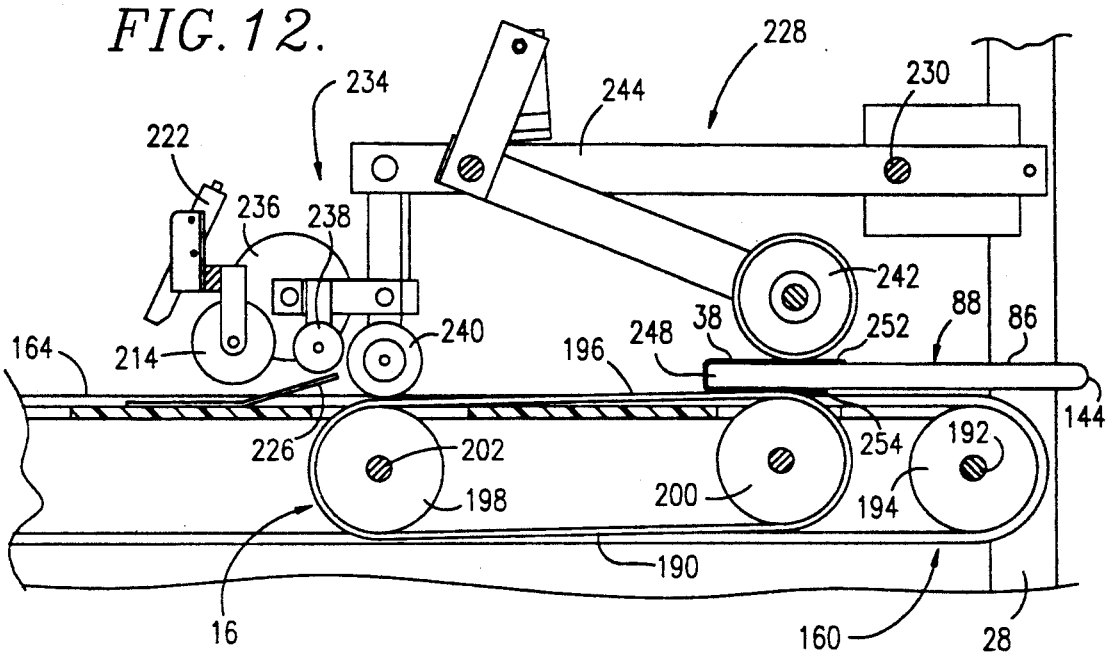
FIG. 12 is a fragmentary vertical cross-sectional view similar to FIG. 11 showing the taped newspaper moving downstream under a pressing member.
Figure 13:
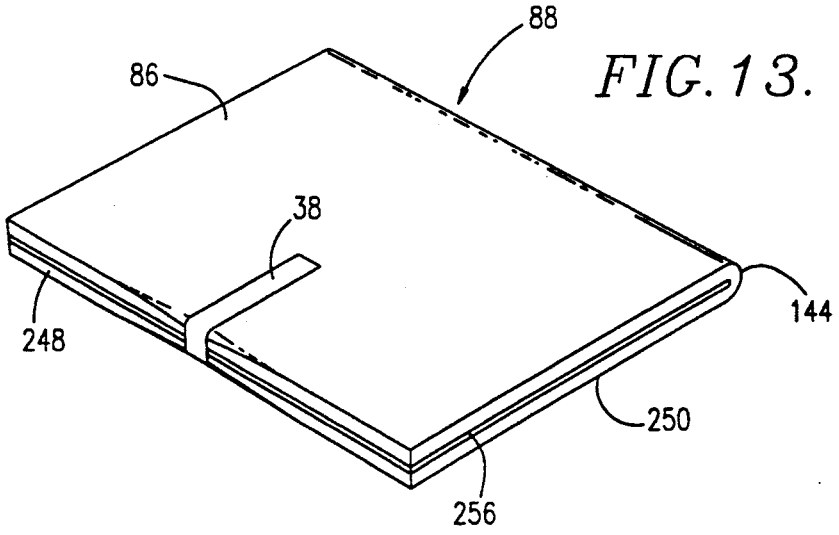
FIG. 13 is a perspective view of the taped newspaper product.

FIG. 12 illustrates a final, important part of the process wherein the tape 38 is pressed to the newspaper 88. Because of the importance of using a light-duty adhesive to avoid tearing the newspaper when the tape 38 is ultimately removed, the tape 38 must be pressed onto the newspaper 88 to ensure that the tape 38 remains attached until intentionally removed and that proper closure of the open end 248 will be obtained. Press cylinder 242 is urged downwardly by gravity and by the action of tension spring 246. It has been found that a force of about 18 pounds for this type of tape is satisfactory. Because the press cylinder 242 is located in opposition to downstream drum 200 of moving belt 190, the downstream drum works as an anvil so that proper pressing may be obtained. FIG. 13 illustrates the final, taped newspaper 88 obtained in accordance with this process wherein loose inserts 256 forming the contents thereof are held within the folded newspaper 88 and prevented from escaping through open edge 248 by the tape 38 applied to the uppermost surface 86, wrapped around the open edge 248, and applied to the lowermost side 250. The tape 38 thus serves to keep the newspaper 88 closed until removed, and thus inhibits the escape of the inserts 256 through the sides of the newspaper intermediate the folded edge 244 and the normally open edge 248.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the liberal scope of the invention as set out in the following claims.

I claim:

1. An apparatus for taping closed the open edge of an assembled newspaper having loose contents, the newspaper having a leading folded edge and an opposed, trailing, open edge and having a first side and a second side. said apparatus comprising:

means for applying a portion of a tape having at least one adhesive-coated side to the first side of the newspaper adjacent the open edge;

means for conveying the newspaper in a downstream direction through the apparatus with the folded edge oriented generally downstream relative to said trailing open edge;

moving means having a surface thereon for receiving the one adhesive-coated side of at least part of an unadhered portion of said tape, including means for moving said surface in a downstream direction at a faster speed than the newspaper, said surface being located proximate to the newspaper during at least a portion of its movement downstream; and means for directing said unadhered portion of said tape toward said surface for initially adhering said unadhered portion of said tape thereto, said moving means comprising an endless, tape-applying belt having an exterior which defines said surface, said surface being capable of having said unadhered portion of the tape initially adhere to the belt and then progressively release from the belt as the belt overtakes the newspaper and transfers the unadhered portion to the second side of the newspaper.

2. An apparatus for taping closed the open edge of an assembled newspaper as set forth in claim 1, including means operably connected to said tape-applying means for sensing the position of the newspaper during movement along said conveying means.

3. An apparatus for taping closed the open edge of an assembled newspaper as set forth in claim 2, wherein said sensing means comprises an electric eye.

4. An apparatus for taping closed the open edge of an assembled newspaper as set forth in claim 1, including means for positively advancing a quantity of tape towards said tape-applying means.

5. An apparatus for taping closed the open edge of an assembled newspaper as set forth in claim 4, wherein said tape-advancing means comprises a rotatable arm having a member attached to a distal end thereof, said member being oriented for engaging a quantity of tape during a portion of the rotational travel of said arm.

6. An apparatus for taping closed the open edge of an assembled newspaper as set forth in claim 1, wherein said first side is the uppermost side of said newspaper, said tape applying means including an arm including structure thereon adapted for engaging the uppermost side of the newspaper.

7. An apparatus for taping closed the open edge of an assembled newspaper as set forth in claim 6, wherein said tape applying means includes means for pivoting said arm into intermittent engagement with the newspaper.

8. An apparatus for taping closed the open edge of an assembled newspaper as set forth in claim 6, said tape applying means including means for cutting the tape.

9. An apparatus for taping closed the open edge of an assembled newspaper as set forth in claim 1, wherein said conveying means includes a pair of transversely spaced carrying belts for supporting said second side of the newspaper.

10. An apparatus for taping closed the open edge of an assembled newspaper as set forth in claim 9, wherein said conveying means includes a pair of transversely spaced driven belts for engaging said first side of said newspaper, said carrying belts and said driven belts being driven at substantially the same speed.

11. An apparatus for taping closed the open edge of an assembled newspaper as set forth in claim 10, wherein said carrying belts and said driven belts are longer than said surface of the tape-applying belt.

12. An apparatus for taping closed the open edge of an assembled newspaper as set forth in claim 1, wherein said belt is provided with a Teflon exterior which defines said surface.

13. An apparatus for taping closed the open edge of an assembled newspaper as set forth in claim 1, wherein said belt is driven at a speed approximately four times as great as the speed of said newspaper moving along said conveying means.

14. An apparatus for taping closed the open edge of an assembled newspaper as set forth in claim 1, including means for pressing said tape onto said newspaper.

15. An apparatus for taping closed the open edge of an assembled newspaper as set forth in claim 14, including means for providing an air jet for urging the tape onto said first side of said newspaper.

16. A method of taping closed the open edge of an assembled newspaper having loose contents, the newspaper having a leading folded edge and an opposed, trailing, open edge and having a first side and a second side, comprising the steps of:

advancing the newspaper in an upstream to downstream direction with the folded edge oriented in a downstream direction;

providing a tape having at least one adhesive-coated side and applying the said adhesive-coated side of a portion of said tape to the first side of the newspaper so that the remainder of said tape is unadhered to said first side of said newspaper;

providing a surface for receiving at least a portion of the remainder of said tape, said surface being located adjacent said second side of the newspaper;

temporarily adhering the adhesive-coated side of at least a part of the remainder of said tape to said surface;

advancing said surface in a downstream direction in adjacency to said second side of said newspaper; and adhering said tape around said trailing open edge and to said second side of said newspaper by transferring the part of the remainder of the tape temporarily adhered to the surface to the second side of the newspaper during movement of the surface in a downstream direction.

17. A method of taping closed the open edge of an assembled newspaper as set forth in claim 16, wherein said surface is located on a driven belt, and including the step of driving said belt in the downstream direction beneath the newspaper.

18. A method of taping closed the open edge of an assembled newspaper as set forth in claim 16, including the step of providing a slack portion of tape prior to applying the adhesive-coated side to said first side of said newspaper.

19. A method of taping closed the open edge of an assembled newspaper as set forth in claim 16, including the step of sensing the movement of said newspaper as it advances in a downstream direction, said tape being applied responsive to said sensing of said newspaper.

20. A method of taping closed the open edge of an assembled newspaper as set forth in claim 16, including the step of pressing said tape onto both said first side and said second side of said newspaper.

21. A method of taping closed the open edge of an assembled newspaper as set forth in claim 16, including the step of supplying said tape from a roll and automatically monitoring the rotation of said roll during application of said tape to said newspaper.

22. A method of taping closed the open edge of an assembled newspaper as set forth in claim 21, including the step of severing the portion of the tape effectively connected to said newspaper from the portion of said tape effectively connected to said roll by means of a selectively actuated knife.

23. An apparatus for taping closed the open edge of an assembled newspaper having loose contents, the newspaper having a leading folded edge and an opposed, trailing, open edge and having a first side and a second side, said apparatus comprising:

a pair of transversely-spaced belts for carrying a newspaper in a downstream direction at a first speed;

a moving belt having a surface thereon positioned for movement downstream at a second speed and in adjacency to the newspaper carried by said transversely-spaced belts;

means for dispensing a quantity of tape and for applying a portion of said tape to a first side of said newspaper and for temporarily adhering at least a part of the remainder of said tape to said surface so that said temporarily adhered part moves at the same speed as said surface; and means for advancing said surface in a downstream direction at a speed sufficiently greater than the speed of said newspaper such that the part of said tape temporarily adhered to the surface is transferred to said second side of said newspaper, said tape thereby extending around said open edge.

24. An apparatus for taping closed the open edge of an assembled newspaper as set forth in claim 23, wherein said tape dispensing and applying means includes a pivotally mounted tape arm.

25. An apparatus for taping closed the open edge of an assembled newspaper as set forth in claim 24, wherein said tape arm pivots in response to travel of a follower effected by rotational movement of a cam.

26. An apparatus for taping closed the open edge of an assembled newspaper as set forth in claim 24, wherein said tape arm includes a pivotally mounted cutter arm actuatable in response to engagement of a follower with a rotatable cam.

27. An apparatus for taping closed the open edge of an assembled newspaper as set forth in claim 23, including pressing means positioned opposite said moving belt for pressing tape onto a newspaper positioned between said pressing means and said moving belt.

28. An apparatus for taping closed the open edge of an assembled newspaper as set forth in claim 27, wherein said pressing means comprises at least one roller.

29. An apparatus for taping closed the open edge of an assembled newspaper as set forth in claim 28, wherein said pressing means comprises a plurality of rollers for progressive engagement with said first side of said newspaper.

30. An apparatus for taping closed the open edge of an assembled newspaper as set forth in claim 23, wherein said tape dispensing means includes means for providing a slack quantity of tape for said tape applying means prior to application of said tape to said first side.

* * * * *